US008814217B2

(12) United States Patent
Key

(10) Patent No.: US 8,814,217 B2
(45) Date of Patent: Aug. 26, 2014

(54) PROGRESS TRACKING AID LABELING FOR MEDICATION CONTAINERS

(75) Inventor: Stephen M. Key, Modesto, CA (US)

(73) Assignee: SpinLabel Technologies, Inc., Boca Raton, FL (US)

( * ) Notice: Subject to any disclaimer, the term of this patent is extended or adjusted under 35 U.S.C. 154(b) by 184 days.

(21) Appl. No.: 13/358,470

(22) Filed: Jan. 25, 2012

(65) Prior Publication Data

US 2013/0026747 A1 Jan. 31, 2013

Related U.S. Application Data

(60) Provisional application No. 61/511,779, filed on Jul. 26, 2011.

(51) Int. Cl.
*G09F 11/23* (2006.01)
*G09F 11/24* (2006.01)

(52) U.S. Cl.
USPC ..... 283/81; 40/310; 40/486; 40/488

(58) Field of Classification Search
CPC .. G09F 11/23; G09F 11/24; G09F 2003/0213
USPC ..... 283/81, 56; 40/486, 488, 310
See application file for complete search history.

(56) References Cited

U.S. PATENT DOCUMENTS 5,809,674 A * 9/1998 Key ..... 40/310
6,129,802 A * 10/2000 Key ..... 40/310
2006/0249950 A1 * 11/2006 Kenney et al. ..... 283/81

* cited by examiner

*Primary Examiner* — Kyle Grabowski
(74) *Attorney, Agent, or Firm* — Carr & Ferrell LLP

(57) ABSTRACT

The present application is directed to progress tracking aids for a medicine container. A base label may be adhered to the medication container, and a plurality of data fields disposed on the base label. A top label may cover at least a portion of the base label.

26 Claims, 18 Drawing Sheets

PROGRESS TRACKING AID LABELING FOR MEDICATION CONTAINERS

CROSS-REFERENCE TO RELATED APPLICATIONS

The present application claims priority to provisional U.S. Patent Application Ser. No. 61/511,779, filed on Jul. 26, 2011, titled "Record Keeping Package to Track Goals and Help Medical Progress," which is hereby incorporated by reference in its entirety.

FIELD OF THE INVENTION

The present application is directed generally to labels, and more specifically to medication container labels that function as a progress tracking aid for recording progress toward a medical goal.

BACKGROUND

More than three billion prescriptions are written each year in the United States, and an estimated $18 billion is spent on over-the-counter medications. Both prescription and over-the-counter medications are intended to be consumed by a patient according to specific instructions for dosage and frequency. The purpose of the medication may be to help the patient achieve progress towards a certain goal. For example, the purpose of the medication may be to reduce blood pressure, reduce (or gain) weight, alleviate joint pain, increase concentration, regulate blood sugar, and the like.

A prescribing health care provider may instruct the patient to keep certain records of information related to measuring progress toward the goal. For example, the patient may be instructed to measure and record blood pressure at certain times of the day while consuming the medication. Both the patient and the health care provider may use this recorded information to gauge progress toward a goal of achieving lower blood pressure.

Maintaining records of patient information may involve writing the information in a notebook or on a piece of paper, or even entry of the information into an electronic database. Over a period of time, the patient may tend to forget about recording the information, lose the notebook or paper, or may not even begin recording the information. An absence of the recorded patient information may deprive the healthcare provider and the patient of valuable information for determining the effects of the medication and proper future course of treatment, resulting in less effective treatment and increased burden on the healthcare system.

SUMMARY

The present application is directed to progress tracking aids for a medication container and methods for tracking progress in connection with taking medication. An exemplary patient progress tracking aid may comprise a base label adhered to a medication container, and a plurality of data fields disposed on the base label. Each data field may correspond to a type of patient information. The progress tracking aid may further comprise a top label covering at least a portion of the base label.

According to additional exemplary embodiments, the present application may be directed to methods for tracking progress in connection with taking medication from a medicine container. An exemplary method may comprise adhering a base label to the medication container, and placing a plurality of data fields on the base label. Each data field may correspond to a type of patient information. At least a portion of the base label may be covered with a top label.

DETAILED DESCRIPTION

The present application is directed to progress tracking aids for a medication container and methods for tracking progress in connection with taking medication. An exemplary patient progress tracking aid may comprise a base label adhered to a medication container, and a plurality of data fields disposed on the base label. Each data field may correspond to a type of patient information. The progress tracking aid may further comprise a top label covering at least a portion of the base label.

Figure 1:
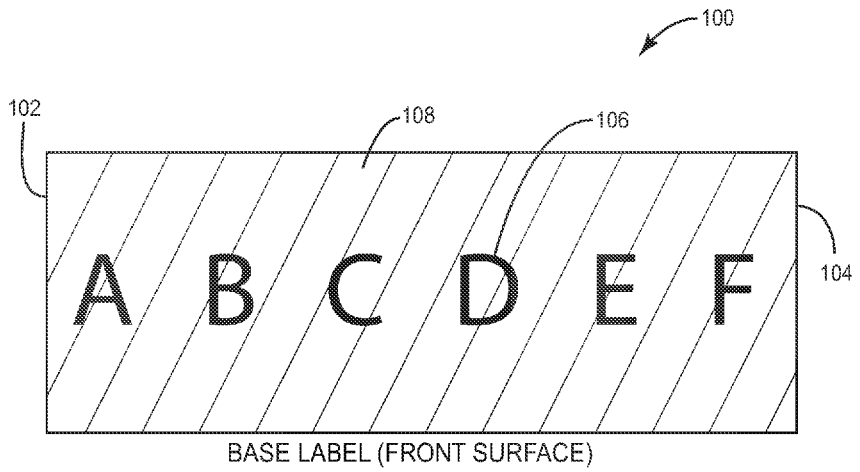
FIG. 1 is a front view of an exemplary label according to various embodiments.

FIG. 1 illustrates various embodiments of a front surface 108 of a base label 100 for an object, such as a medication container, according to various embodiments. The base label 100 comprises a leading edge 102 and a trailing edge 104. While the leading edge 102 is oriented to the left and the trailing edge is oriented to the right, as presented in FIG. 1, the orientation of the leading edge 102 and the trailing edge 104 could be reversed depending on which edge is first applied to the object. Both orientations are within the scope of the present disclosure. Base label front surface 108 may comprise writing or other indicia 106 thereon.

As used herein, the leading edge refers to the first edge to be affixed to the object and the trailing edge refers to the second edge to be affixed to the object or the overlapping leading edge. Depending on the orientation of the label and the object when the label is affixed to the object, either edge of the label may be the leading edge. The orientations presented in the figures are for convenience and are not intended to be limiting in any way.

Figure 2:
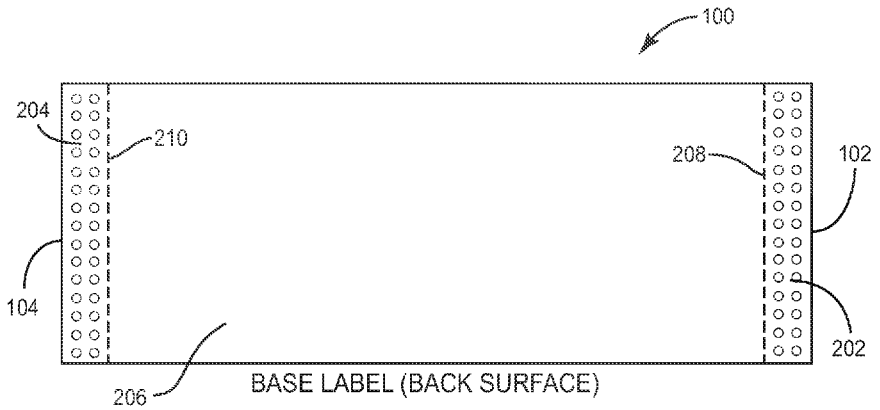
FIG. 2 is a back view of an exemplary label according to various embodiments.

FIG. 2 illustrates various embodiments of a back surface 206 of the base label 100. In various embodiments, the base label back surface 206 comprises two strips of adhesive 202 and 204 on or immediately adjacent to the leading and trailing edges, 102 and 104, respectively. Base label leading edge adhesive 202 may have a boundary 208 defined as its limit on the base label back surface 206. Base label trailing edge adhesive 204 may also have a boundary 210. While FIG. 2 illustrates that the adhesive strips 202 and 204 are generally close to the base label leading and trailing edges 102 and 104, respectively, it is understood that the adhesive strips 202 and 204 may be continuous or discontinuous, and may extend across any portion of the base label back surface 206, including the entire base label back surface 206. In various embodiments, a length of the base label 100 may be selected to be slightly longer than a circumference of the object on which it is placed, such that the trailing edge 104 overlaps the leading edge 102, and the trailing edge 104 is affixed to the leading edge 102. In various embodiments, the length of the base label 100 may be selected to be approximately the same as the circumference of the object on which it is placed, such that the leading edge 102 and the trailing edge 104 do not overlap.

Figure 3:
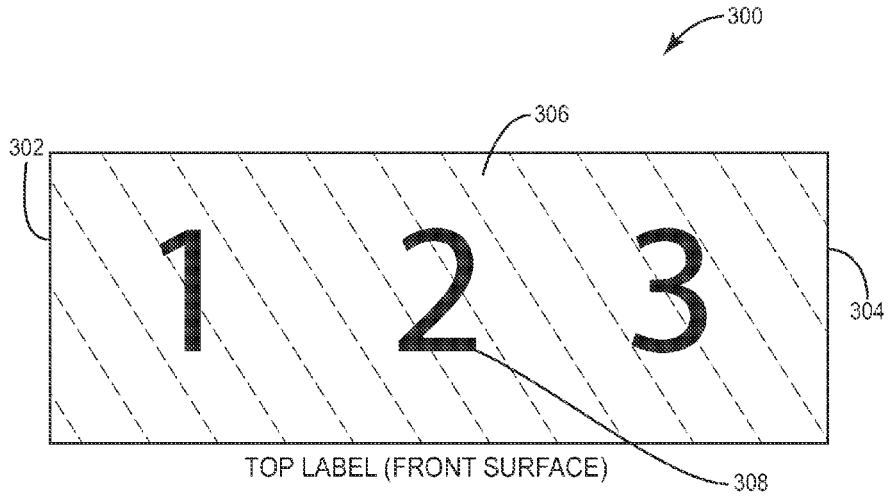
FIG. 3 is a front view of an exemplary label according to various embodiments.

FIG. 3 illustrates various embodiments of a front surface 306 of a top label 300. Top label 300 comprises a leading edge 302 and a trailing edge 304, and indicia 308 may be imprinted on the top label front surface 306.

Figure 4:
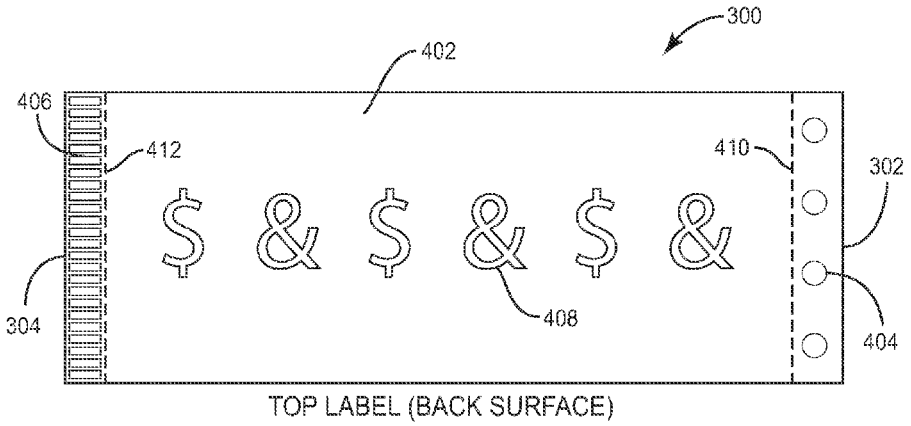
FIG. 4 is a back view of an exemplary label according to various embodiments.

Various embodiments of a back surface 402 of the top label 300 are illustrated in FIG. 4. The top label back surface 402 may comprise various indicia 408 printed thereon, as well as two strips of adhesive 404 and 406 on or immediately adjacent to the leading and trailing edges, 302 and 304, respectively. Top label leading edge adhesive 404 may have a boundary 410 defined as its limit on the top label back surface 402. Top label trailing edge adhesive 406 may also have a boundary 412. While FIG. 4 illustrates that the adhesive strips 404 and 406 are generally close to the top label leading and trailing edges 302 and 304, respectively, it is understood that the adhesive strips 404 and 406 may be continuous or discontinuous, and may extend across any portion of the top label back surface 402, including the entire top label back surface 402. In various embodiments, the adhesive strips 404 and 406 are confined to areas near the leading and trailing edges 302 and 304, respectively, so as not to obscure or interfere with the top label back surface indicia 408.

The base label adhesive 202, 204 and the top label adhesive 404, 406 may be applied in a variety of patterns as can be appreciated by one skilled in the art. The adhesive 202, 204, 404, 406 may be applied in in strips, dots, droplets, circles, rectangles, squares, triangles, lines, and the like, as well as combinations of patterns.

A length of the top label 300 may be selected to be slightly longer than a circumference of the object on which it is placed, such that the top label trailing edge 304 overlaps the top label leading edge 302, and the top label trailing edge 304 is affixed to the top label leading edge 302. In various embodiments, the length of the top label 300 may be selected to be approximately the same as the circumference of the object on which it is placed, such that both the leading edge 302 and the trailing edge 304 do not overlap and are affixed to the base label front surface 108.

Figure 5A:
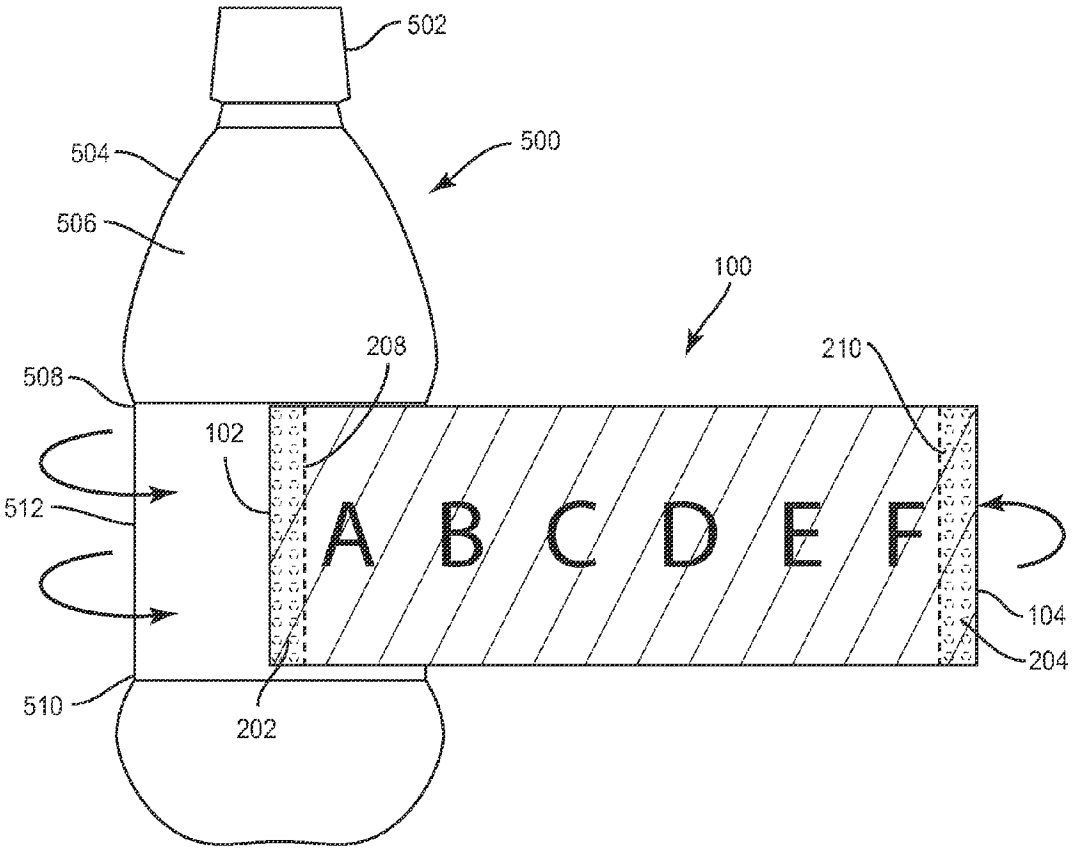
FIG. 5A illustrates a leading edge of an exemplary label affixed to a container according to various embodiments.

FIG. 5A illustrates the application of the base label 100 to an exemplary container 500 according to various embodiments. The container 500 may be a glass or plastic bottle, or other type of container, such as a metal can or a cardboard receptacle. The container may be round, rectangular, square, or any other shape known in the art. The term "container" is used here for convenience to describe exemplary embodiments. It is understood that the container may be any object, including non-containers. Container 500 may comprise a cap 502 removably secured to a body 504. Various embodiments of the body 504 may have an exterior surface 506 that comprises a upper label panel 508, a lower label panel 510, and a recessed surface 512 interposed between the upper label panel 508 and the lower label panel 510. As discussed below, the base label 100 may be applied to the container 500 at the recessed area 512 between the upper label panel 508 and the lower label panel 510.

In various embodiments, the top label 300 may be rotatable about the base label 100, as discussed below. In these embodiments, the upper label panel 508 and lower label panel 510 may function to restrict upward and downward movement of the top label 300 in relation to the container 500 such that the top label 300 generally remains in a position covering at least a portion of the base label 100.

Figure 5B:
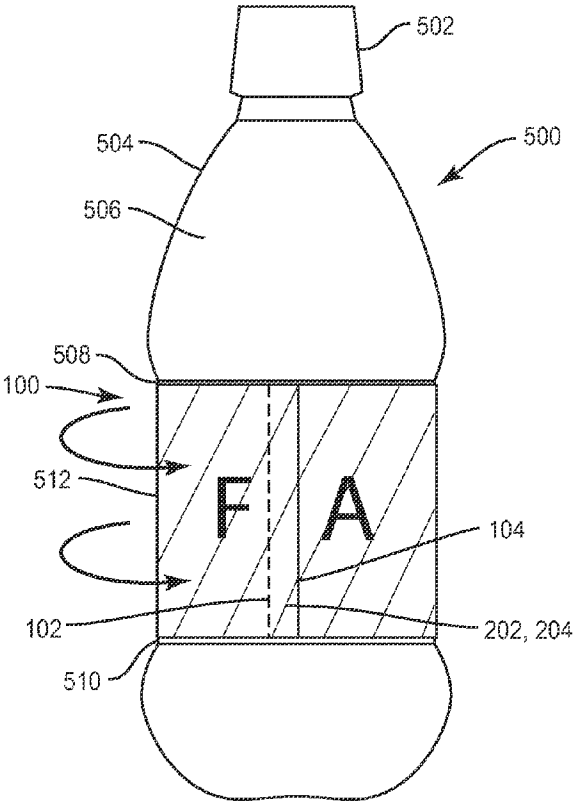
FIG. 5B illustrates an exemplary label secured about a container according to various embodiments.

FIG. 5B illustrates the container 500 with the base label 100 affixed to the container 500. Initially, as illustrated in FIG. 5A, base label leading edge 102 is placed in contact with the recessed surface 512 of the container 500 and affixed to the container 500 by the leading edge adhesive strip 202. With relative motion between the container 500 and the base label 100, the base label 100 may be wrapped around the container 500 with the base label trailing edge 104 now overlapping the base label leading edge 102 such that the leading edge adhesive strip 202 holds the base label leading edge 102 to the container 500 while the trailing edge adhesive strip 204 holds the base label trailing edge 104 to the overlapped base label leading edge 102.

Figure 6:
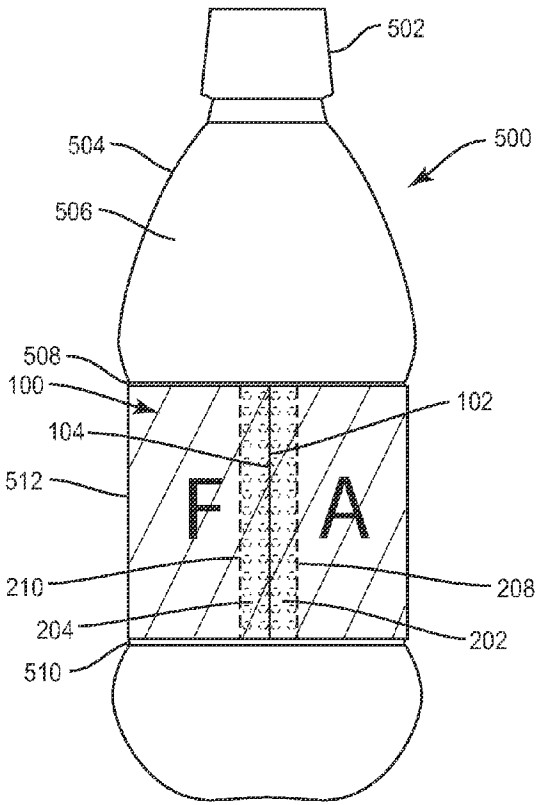
FIG. 6 illustrates an exemplary label secured about a container according to various embodiments.
Figure 7:
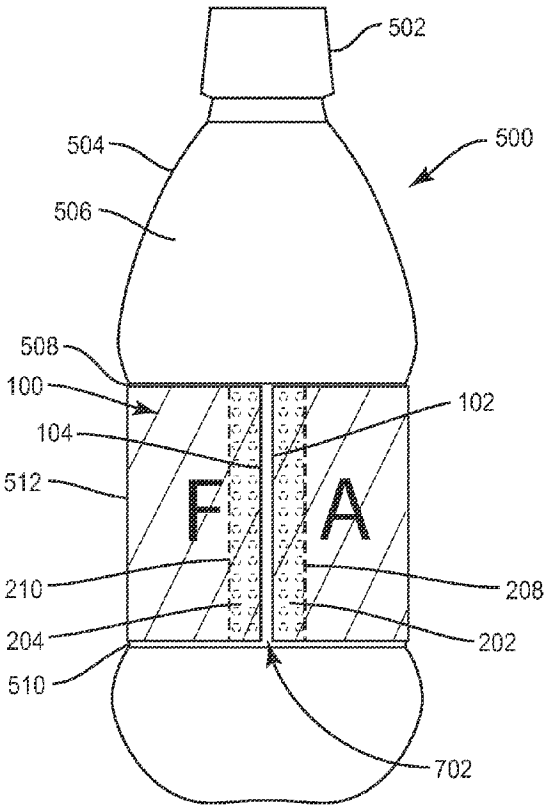
FIG. 7 illustrates an exemplary base label secured about a container according to various embodiments.

In various embodiments as illustrated in FIG. 6, the length of the base label 100 may be substantially the same as a circumference of the recessed surface 512 of the container 500, which may allow the base label leading edge 102 and base label trailing edge 104 to abut rather than overlap. However, it is also possible that the length of the base label 100 may be shorter than the circumference of the recessed surface 512, resulting in a gap 702 between the base label leading edge 102 and the base label trailing edge 104 when the base label 100 is affixed to the recessed surface as illustrated in FIG. 7. In both of these instances, the base label trailing edge adhesive strip 204 may adhere to the recessed surface 512 of the container 500, rather than the base label leading edge 102.

In various embodiments, the base label adhesive strips 202, 204 may comprise a permanent adhesive. In general, a permanent adhesive is one that does not readily release from a surface to which it adheres after the adhesive dries or cures. Using the base label 100 as an example, the permanent adhesive 202, 204 will tend not to release from the recessed surface 512, nor will it tend to release the base label leading edge 102 or trailing edge 104 once dried or cured. In order to remove the base label from the recessed surface 512, the base label 100 may have to be torn from the adhesive, or the adhesive layer 202, 204 may have to be fractured which may leave some of the adhesive on the recessed surface 512 and some of the adhesive on the base label leading edge 102 or trailing edge 104. Once the surfaces affixed with the permanent adhesive are separated, they may not be reattached.

Figure 8:
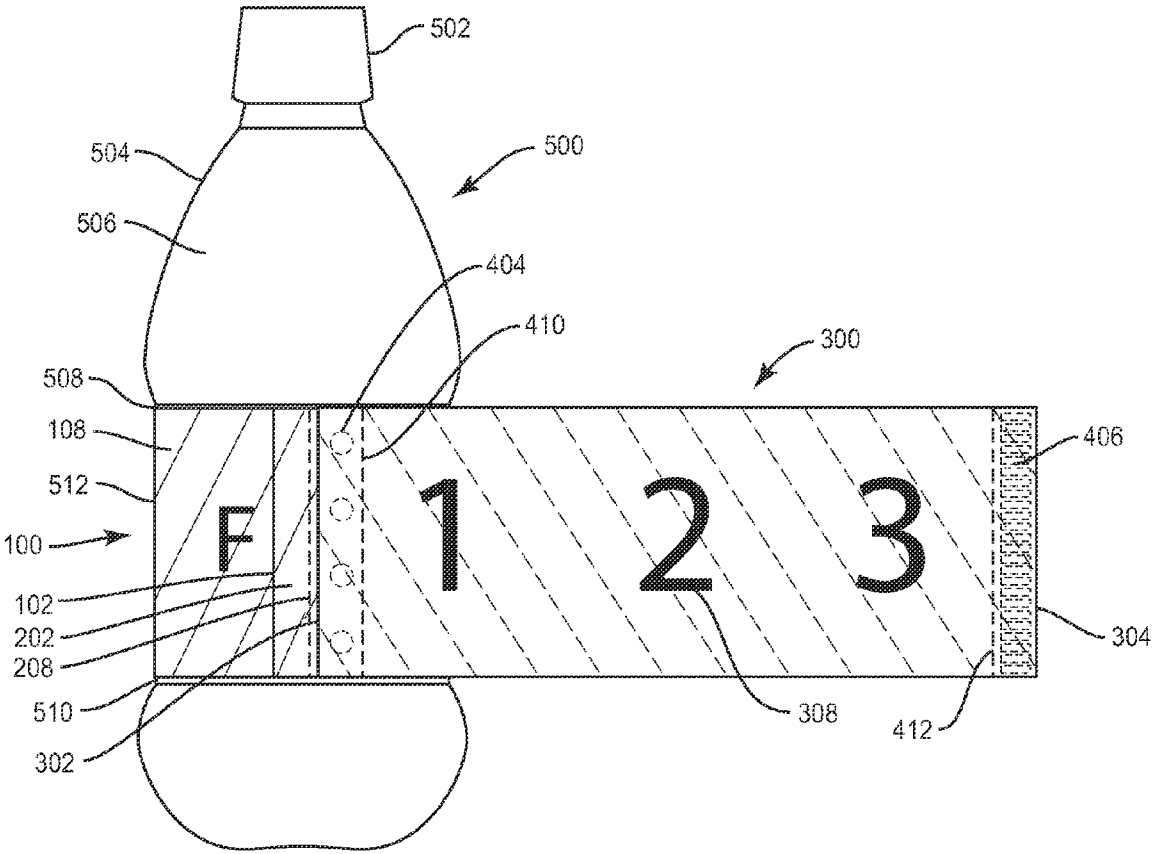
FIG. 8 illustrates a leading edge of an exemplary top label affixed to an exemplary base label according to various embodiments.

In FIG. 8, the base label 100 is already affixed to the recessed surface 512 of the container 500, and the application of the top label 300 over the base label 100 is illustrated according to various embodiments. The top label leading edge 302 may be placed in contact with any portion of the base label front surface 108 and affixed to the base label front surface 108 by the top label leading edge adhesive strip 404. With relative motion between the container 500 and the top label 300, the top label 300 may be wrapped around the container 500 with the top label trailing edge 304 now overlapping the top label leading edge 302, such that the top label leading edge adhesive strip 404 holds the top label leading edge 302 to the base label 100 while the top label trailing edge adhesive strip 406 holds the top label trailing edge 304 to the overlapped top label leading edge 302.

Figure 9:
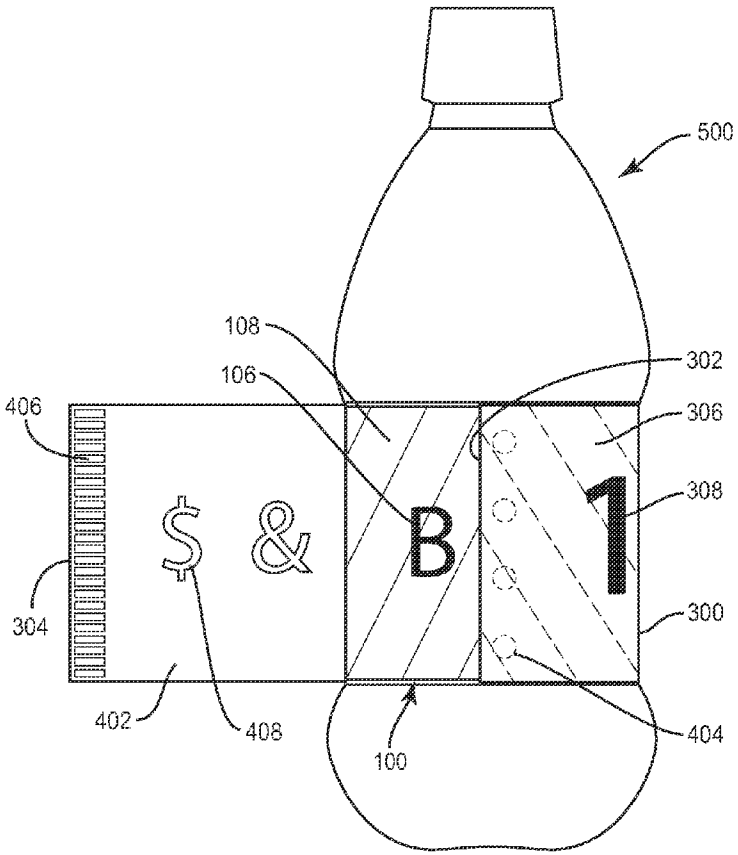
FIG. 9 illustrates an exemplary top label affixed to an exemplary base label and partially wrapped about a container according to various embodiments.

FIG. 9 illustrates the operation of the base label 100 and the top label 300 according to various embodiments. Beginning with the container 500 with the base label 100 and the top label 300 in place as shown, for example, in FIG. 6, the top label trailing edge 304 may be detached from the top label leading edge 302 and at least partially peeled back as shown in FIG. 9. The combination of the base label 100 and the top label 300 in this configuration increases the amount of surface area available for viewing by a consumer or user of the container 500. Prior to detaching the top label trailing edge 304, the consumer may view the top label front surface 306. Upon detaching the top label trailing edge 304, the consumer may now view the top label back surface 402 and the base label front surface 108, in addition to the top label front surface 306.

One of at least three types of adhesive may be used for the top label leading edge adhesive 404. A first type of adhesive is the permanent adhesive, as described above for the base label 100. When a permanent adhesive is used for the top label leading edge adhesive 404, the top label leading edge generally cannot be detached without inflicting damage to one or both of the top label 300 or the base label 100. This may be desirable for various embodiments where the top label 300 is not intended to be removed from the container 500.

A second type of adhesive that may be used for the top label leading edge adhesive 404 is a releasable adhesive. A releasable adhesive is one that will release from a surface to which it is attached once a sufficient mechanical force is applied. A releasable adhesive may be used, for example, when the top label back surface 402 comprises a coupon for a subsequent purchase of a product. The releasable adhesive may allow the consumer to easily remove the top label 300 for later use. In various embodiments, the releasable adhesive may be a breakaway adhesive. A breakaway adhesive may have limited ability to withstand shear stresses. Shear stresses may cause the adhesive bond created between the label (e.g., top label 300) and the surface to which it is affixed (e.g., the base label 100 or container 500) to fail along the adhesive. In general, a releasable or breakaway adhesive may not re-attach to a surface once removed.

A third type of adhesive that may be used for the top label leading edge adhesive 404 is a resealable adhesive. A resealable adhesive may release from a surface to which it is attached once a sufficient mechanical force is applied, similar to the releasable adhesive described above. However, the resealable adhesive may be re-attached to a surface by applying pressure. A resealable adhesive may be desirable when the top label back surface 402 or the base label front surface 108 comprise information that may be needed only on occasion. Thus, the consumer or user may detach the top label 300 when the information is needed, then re-attach the top label 300.

In various embodiments, the top label trailing edge adhesive 406 may be a releasable adhesive or a resealable adhesive, depending on the intended use of the top label 300. As described above, if the surfaces 108, 402 comprise information that is intended to stay with the container, the top label trailing edge adhesive 406 may be a resealable adhesive. In contrast, if the top label 300 is intended to be removed from the container 500, a releasable adhesive may be desirable.

Figure 10:
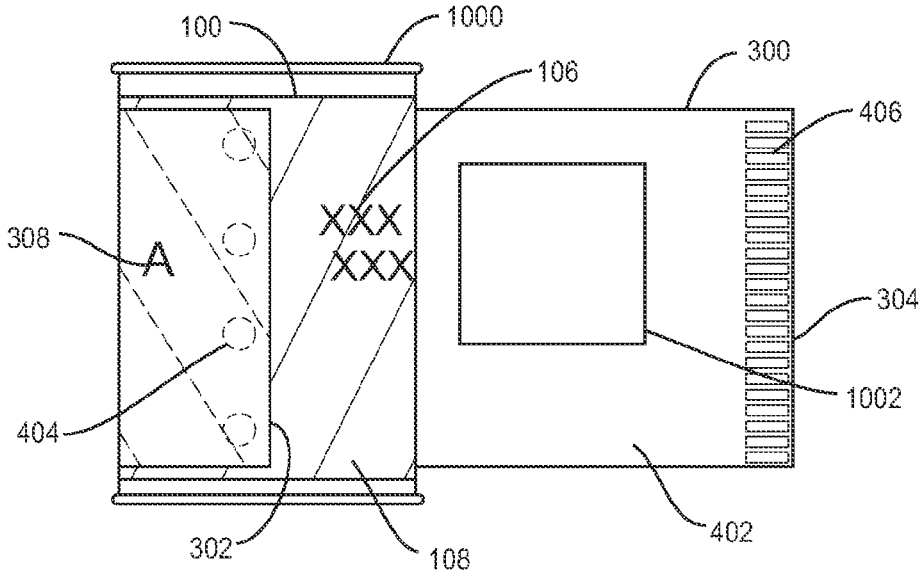
FIG. 10 illustrates an exemplary top label with a window affixed to an exemplary base label and partially wrapped about a container according to various embodiments.

FIG. 10 illustrates various embodiments of the top label 300 comprising a window 1002. The window 1002 may comprise a void in the top label 300 such that a portion of the base label 100 may be visible through the window. In various embodiments, the window 1002 may have a transparent covering (not shown). In various other embodiments, the window may comprise a transparent section of the top label 300 itself rather than a void. FIG. 10 illustrates the top label 300 partially wrapped about a container 1000, and base label 100 already in place on the container 1000. As shown, the top label leading edge adhesive 404 maintains the top label 300 coupled to the base label 100. The top label 300 may then be moved from the position illustrated in FIG. 10 to the position illustrated in FIG. 11 to secure the top label 300 about the container 1000. Top label trailing edge adhesive 406 may couple to the top label leading edge 302 if the top label leading edge 302 and trailing edge 304 overlap; otherwise, the top label trailing edge adhesive 406 may be coupled to the base label front surface 108.

Figure 11:
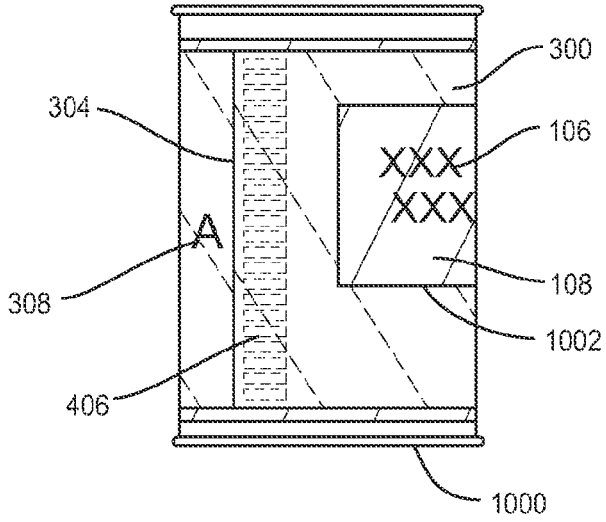
FIG. 11 illustrates an exemplary top label with a window secured about a container and a portion of a base label visible through the window according to various embodiments.

Once the top label 300 is in position on the container 1000, as illustrated in FIG. 11, at least a portion of the base label front surface indicia 106 may be visible through the window 1002. This may allow viewing of a first portion of the base label 100 without removing the top label 300. In various embodiments, the top label leading edge adhesive 404 may be a breakaway adhesive. Rotation of the top label 300 relative to the base label 100 may exert shear stresses on the breakaway adhesive, causing the adhesive bond affixing the top label leading edge 302 to the base label 100 to fail. The top label 300 may then be freely rotatable about the base label 100, and a second portion of the base label 100 may be visible when the top label 300 is rotated to a second position. The window 1002 may be rectangular, as illustrated in FIGS. 10 and 11, or any other shape as needed for a particular application. For example, the window 1002 may be a slit that reveals an alphanumeric string on the base label 100. In various embodiments, the top label 300 may comprise more than one window 1002. Various embodiments in which the top label trailing edge adhesive 406 is a resealable or releasable adhesive may allow the top label 300 to be peeled back to reveal the top label back surface 402 and essentially the entire base label front surface 108 or to be removed from the container 1000, in addition to being rotatable.

One skilled in the art will readily recognize that labels may be applied to containers using a variety of methods and that there may be a variety of single-label and multi-label systems other than those described above. Any such application methods or label systems may be used with the present disclosure. The above descriptions are exemplary and not to be construed as limiting in any way. Examples of other application methods and label systems may be disclosed in U.S. Pat. Nos.

5,884,421, 6,086,697, 6,237,269, 6,402,872, 6,631,578, 6,649,007, 7,087,298, and 7,172,668.

Figure 12A:
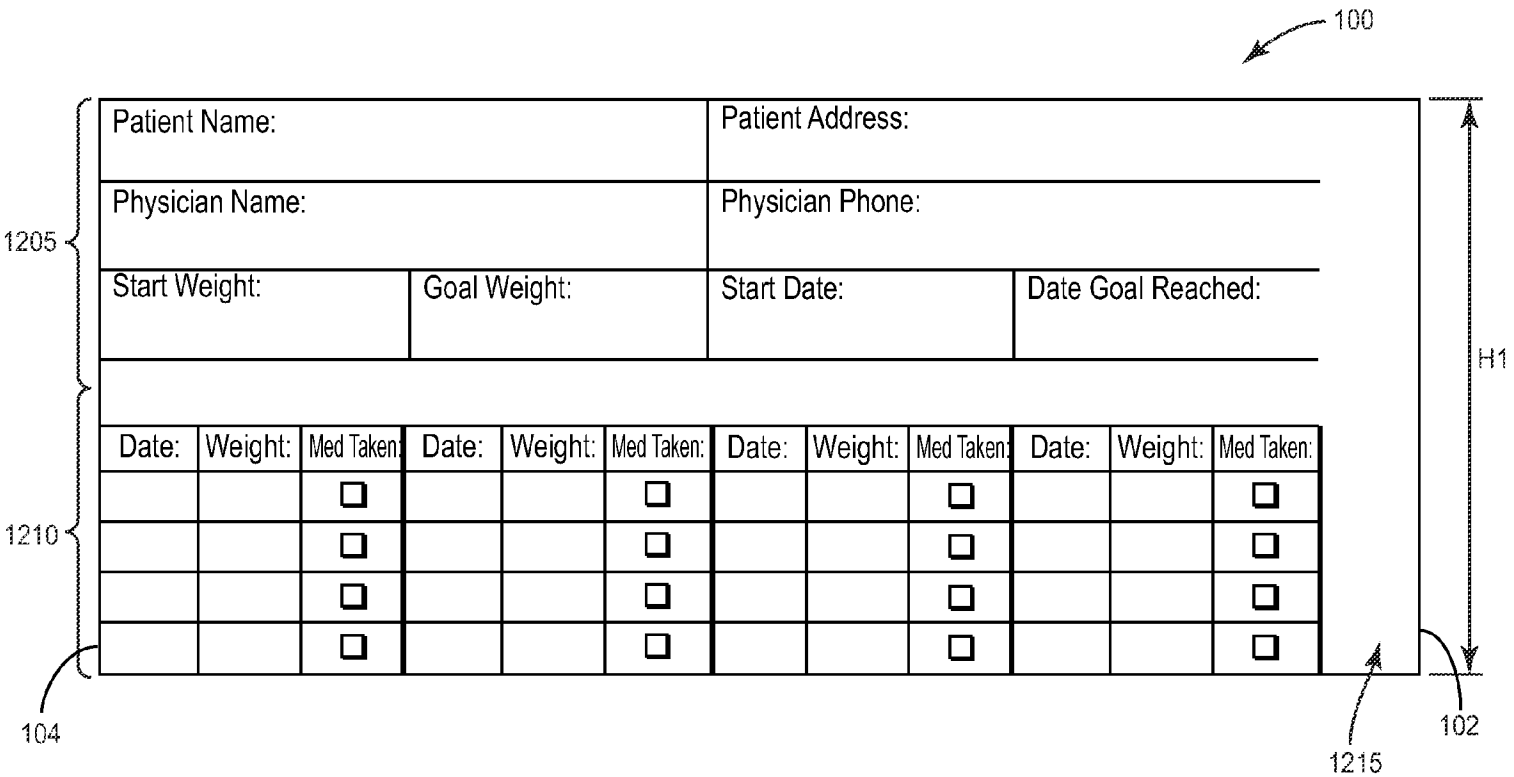
FIG. 12A is a front view of a base label according to various embodiments.

FIG. 12A illustrates various embodiments of a base label 100 comprising a patient identification information section 1205 and a patient progress tracking information section 1210. The patient identification information section 1205 may comprise a plurality of data fields, each data field corresponding to a type of patient identification information. Exemplary types of patient identification information comprise patient name, patient birthdate, patient weight (such as starting weight, ending weight, goal weight), patient contact information (such as address, phone number, email address, social media address), healthcare provider name, date medication was administered, and the like.

The patient progress tracking information section 1210 may also comprise a plurality of data fields, each data field corresponding to a type of patient progress tracking information. A wide variety of data fields may appear in the patient progress tracking information section 1210, and the specific patient tracking information data fields on any given base label 100 may be related to an intended effect of the medicine on the patient. For example, the exemplary embodiment of the base label 100 in FIG. 12A may correspond to the intended effect of losing weight. Thus, exemplary data fields may comprise the date, weight of the patient, and an indicator of patient compliance with consuming the medicine, such as a check box to indicate the medicine was consumed that day. As one skilled in the art will readily recognize, the scope of the present disclosure is not limited by these enumerated data fields. Any data fields corresponding to any intended effect (or unintended effect such as a side effect) of any medicine is within the scope of the present disclosure.

Figure 12B:
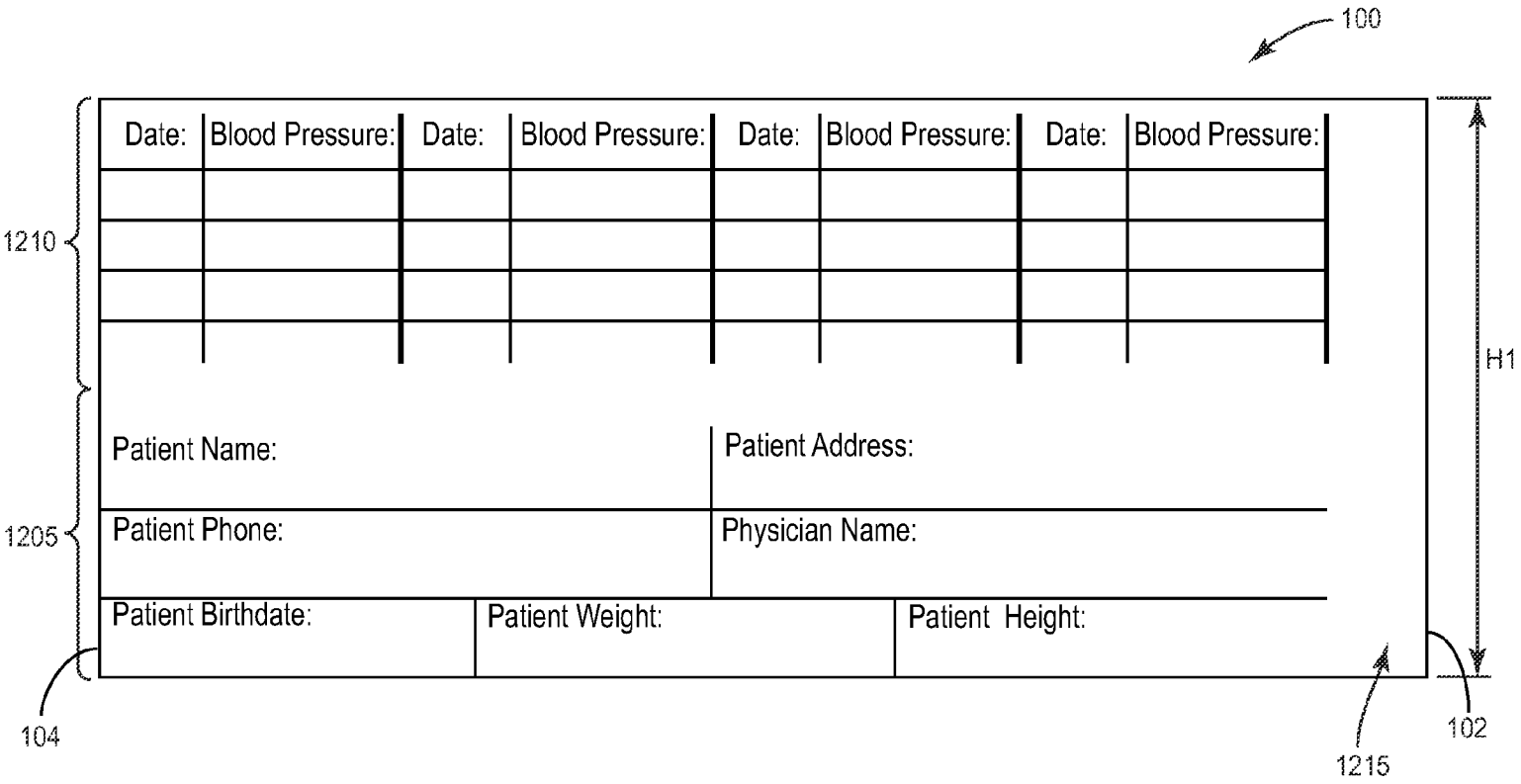
FIG. 12B is a front view of a base label according to various embodiments.

As a further example, FIG. 12B illustrates a base label 100 comprising a patient identification information section 1205 and a patient progress tracking information section 1210. In this example, an intended effect of the medicine may be to regulate blood pressure. Thus, the patient progress tracking information data fields may comprise the date and one or more blood pressure readings corresponding to each date. Other exemplary patient progress tracking information data fields may comprise body temperature, height, level of pain, level of mobility, hours of sleep, level of hearing, level of energy, and the like. As mentioned above, the patient progress tracking information data fields may be used to track side effects, and corresponding data fields may comprise whether undesirable effects occur, such as headaches, blurred or loss of vision, aching joints, hallucinations, sleeplessness, change in skin color, and the like.

According to various embodiments, the patient identification information section 1205 and the patient progress tracking information section 1210 may each occupy an upper portion or lower portion of the base label 100. FIG. 12A illustrates the patient identification information section 1205 positioned in the upper portion of the base label 100 and the patient progress tracking information section 1210 positioned in the lower portion of the base label 100. FIG. 12B illustrates the opposite arrangement.

The various embodiments of the base label 100 as illustrated in FIGS. 12A and 12B may comprise a blank portion 1215 along the leading edge 102 that is essentially void of any indicia 106. As described previously, the trailing edge 104 may overlap the leading edge 102 when the base label 100 is applied to the container. The blank portion 1215 provides a space for attachment of the trailing edge without obscuring any of the indicia 106.

Figure 13:
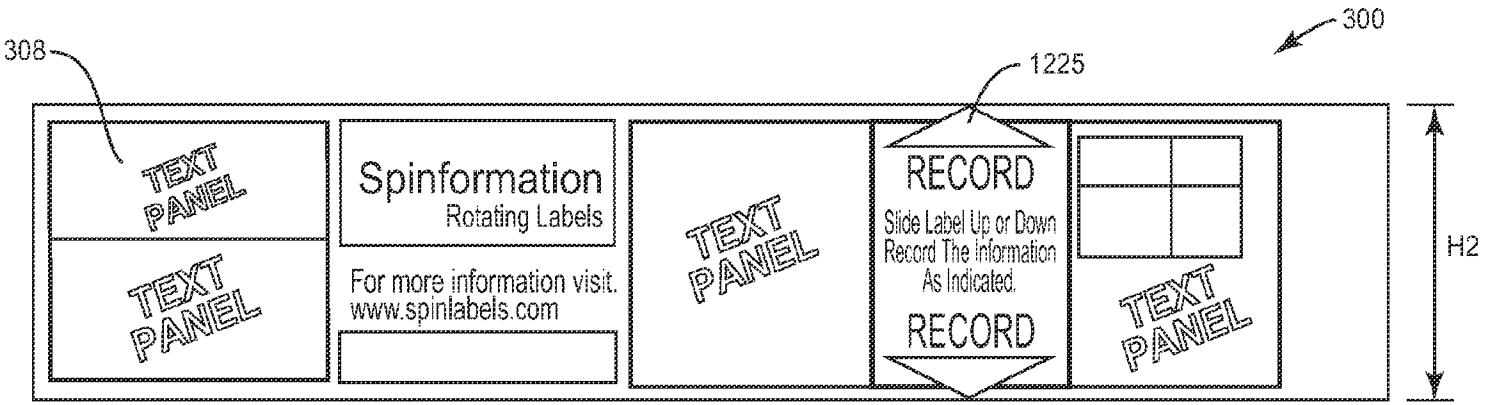
FIG. 13 is a front view of a top label according to various embodiments.

FIG. 13 illustrates a top label 300 according to various embodiments. Top label 300 may comprise indicia 308 relaying medication-related information, patient-related information, medical provider-related information, and the like. Additionally, the top label 300 may comprise a progress tracking indicia 1225 which may be used to indicate the next data field to be completed.

The base label 100 may have a height H1 as illustrated in FIGS. 12A and 12B, and the top label 300 may have a height H2 as illustrated in FIG. 13. In various embodiments, the height H2 of the top label 300 may be selected to be less than the height H1 of the base label 100, such that when the top label 300 is positioned over the base label 100, as described more fully below, either the upper portion or lower portion of the base label 100 may be visible.

Figure 14A:
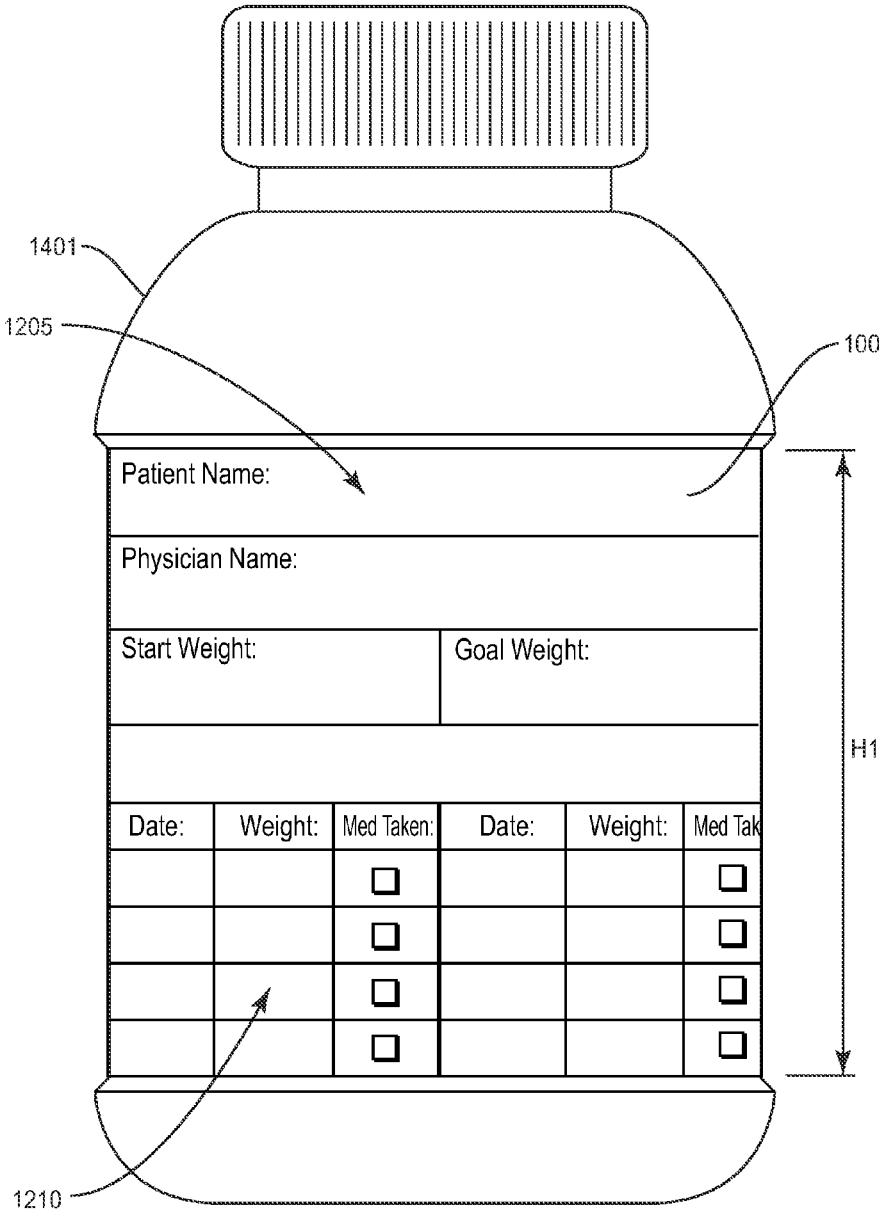
FIG. 14A illustrates an exemplary base label secured about a container according to various embodiments.
Figure 14B:
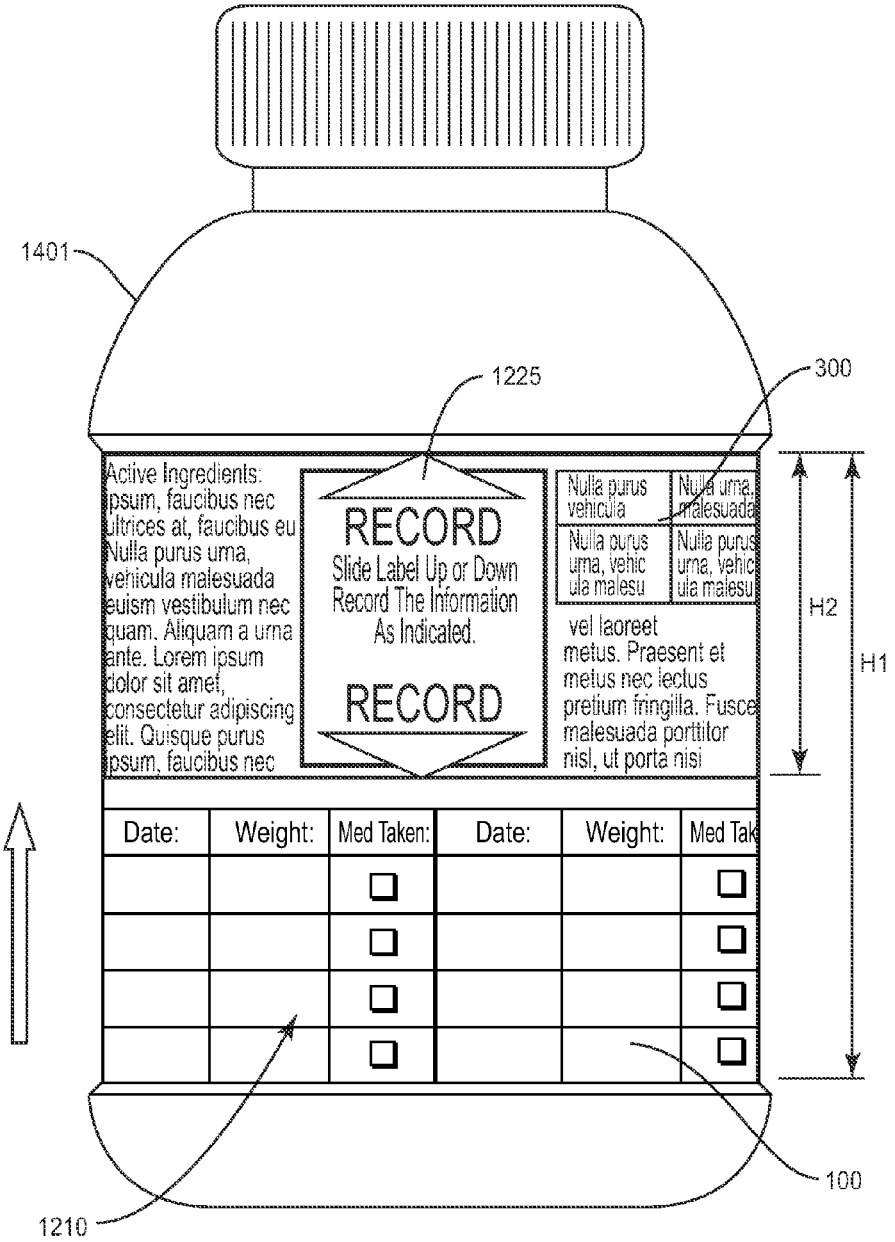
FIG. 14B illustrates an exemplary base label and top label secured about a container according to various embodiments.
Figure 14C:
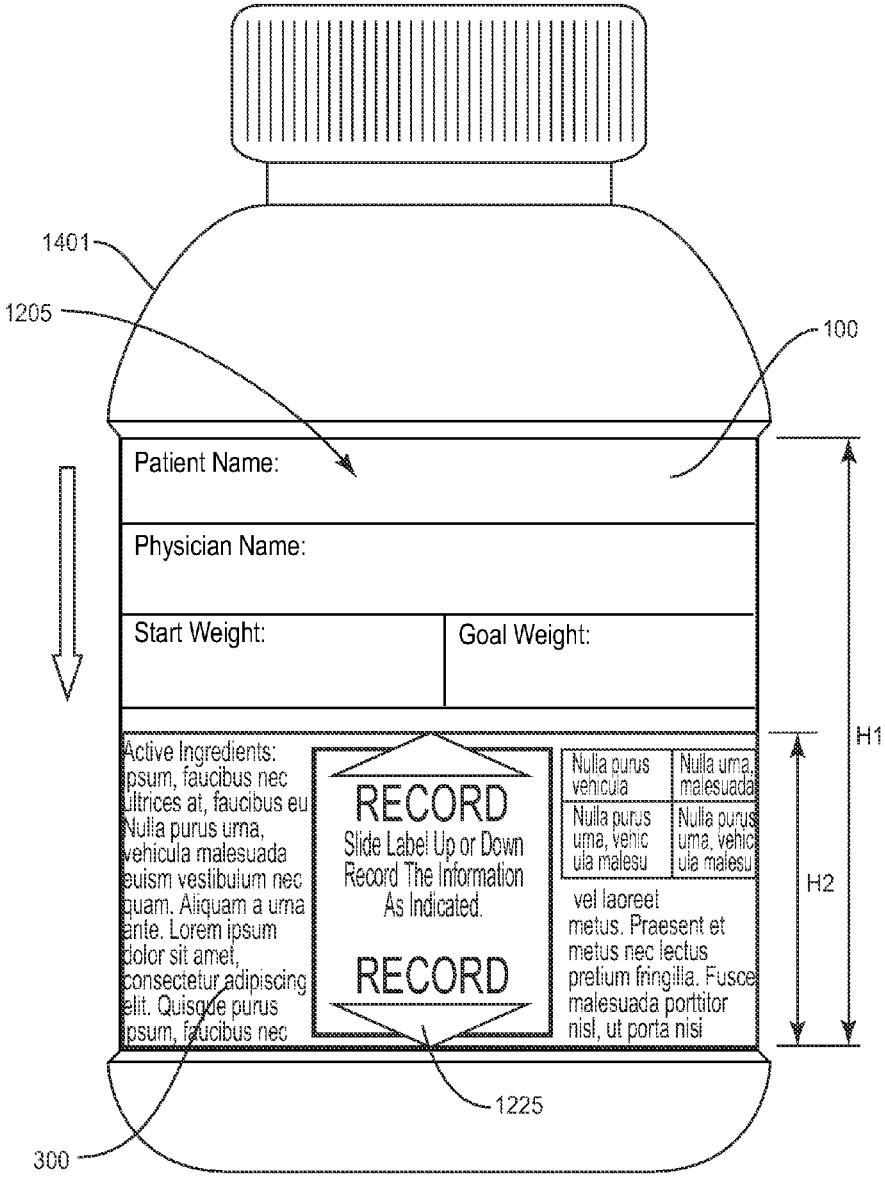
FIG. 14C illustrates an exemplary base label and top label secured about a container according to various embodiments.
Figure 15A:
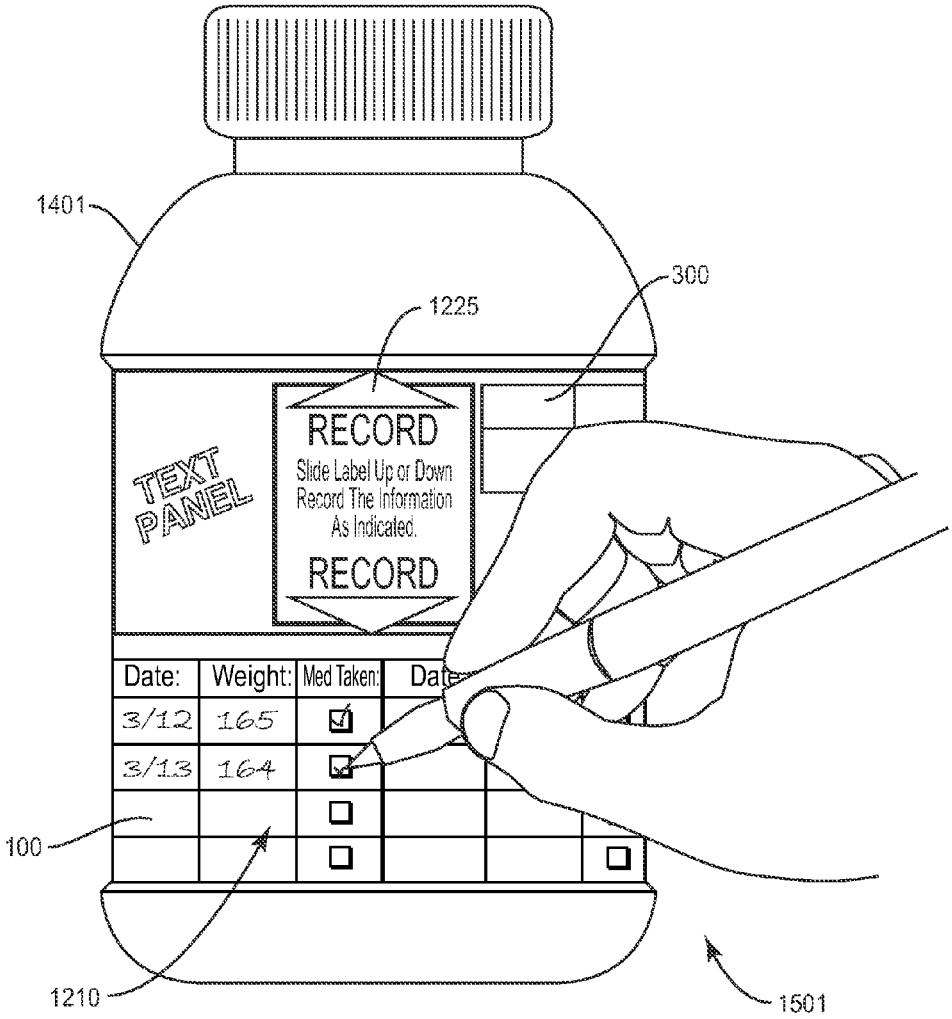
FIG. 15A illustrates a markable base label secured about a container according to various embodiments.
Figure 15B:
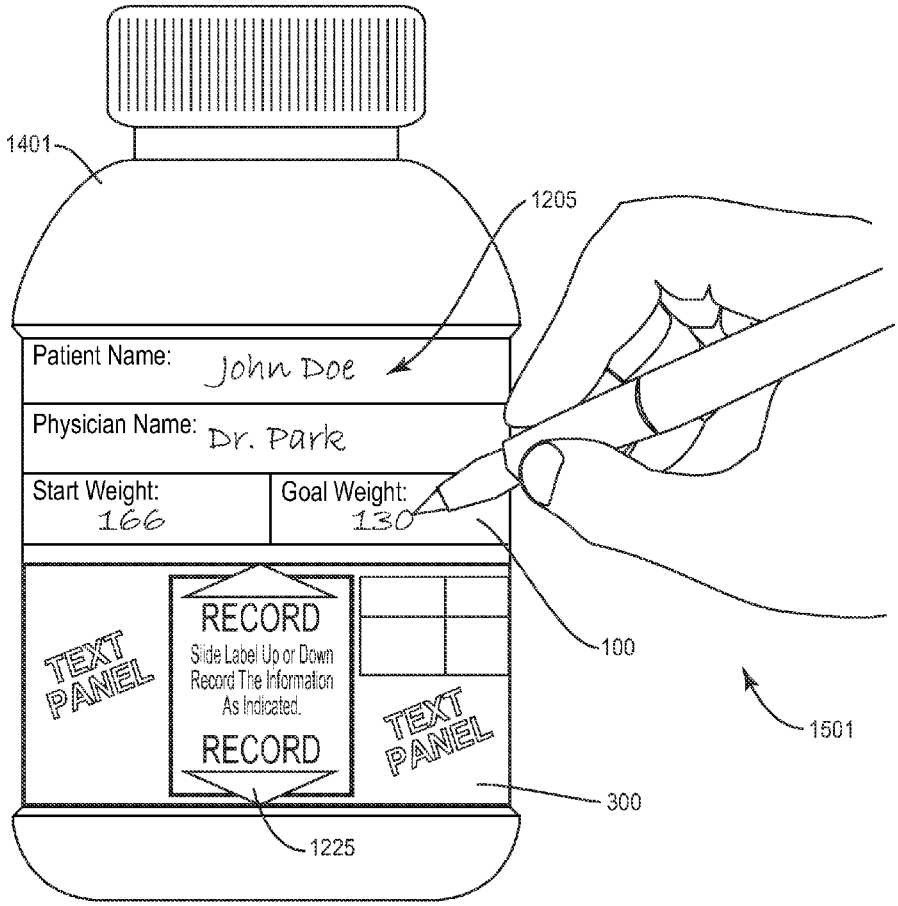
FIG. 15B illustrates a markable base label secured about a container according to various embodiments.

FIGS. 15A-15B illustrate the base label 100 and top label 300 on a medication container 1401 according to various embodiments. The base label 100 and the top label 300 may comprise a progress tracking aid that may be used, for example, on the medication container 1401 as illustrated in FIGS. 14A-14C. In FIG. 14A, the base label 100 is positioned on the medication container 1401, and the base label 100 may comprise the patient identification information section 1205 and the patient progress tracking information section 1210. FIG. 14B illustrates the top label 300 in place over the base label 100. As described previously, the top label 300 may be applied such that the top label 300 is rotatable around a circumference of the medication container 1401 and slidable up and down along at least a portion of a length of the medication container 1401. In FIG. 14B, the top label 300 has been slid upward in the direction of the arrow revealing the patient progress tracking information section 1210 along the lower portion of the base label 100 and covering the patient identification information section 1205 along the upper portion of the base label 100. Similarly, FIG. 14C illustrates the top label 300 slid downwards in the direction of the arrow, thus revealing the patient identification information section 1205 along the upper section of the base label 100 and covering the patient progress tracking information section 1210 along the lower section of the base label 100.

In FIG. 14B, the top label 300 may be rotated such that the progress tracking aid 1225 lines up with the next data field to be completed. As illustrated in FIG. 15B, the progress tracking aid 1225 indicates that the next data field to be completed should be the check box indicating that the medication has been taken. Similarly, when the top label 300 is slid downward as illustrated in FIG. 14C, the progress tracking aid 1225 may indicate that the data fields in the patient identification information section 1205 should be completed. After each dose is consumed, the patient may rotate the top label 300 so that the progress tracking aid 1225 lines up with the next data field to be completed.

The data fields in the patient identification information section 1205 and the patient progress tracking information section 1210 may be markable with a writing instrument such as a pen or pencil. FIG. 15A illustrates various embodiments in which the data fields in the patient progress tracking information section 1210 are markable with a writing instrument 1501. The patient may write the appropriate information in each data field or mark a check box. In the example of FIG. 15A, the patient has just consumed the dose for March 3 and is marking the check box indicating the medication has been taken after entering the date and weight in the corresponding data fields. The patient may then rotate the top label 300 until the progress tracking aid 1225 lines up with the "Date" data field for the next entry.

Similarly, FIG. 15B illustrates various embodiments in which the top label 300 has been slid downwards, revealing the patient identification information section 1205. The writing instrument 1501 may be used to complete the data fields as appropriate. In the example of FIG. 15B, the patient has completed the "Patient Name," "Physician Name," and "Start Weight" data fields and is in the process of completing the "Goal Weight" data fields.

The patient identification information section 1205 and the patient progress tracking information section 1210 may comprise, or alternatively may be coated with, a scratchable substance. In various embodiments, the patient may scratch off the scratchable substance at the appropriate data field rather than writing on the data field. In various embodiments, the scratchable substance may not be a coating, but rather may be the base label 100 itself. For example, the base label 100, or a portion of the base label 100 where the data fields are located, may comprise a substance that darkens when scratched.

The top label 300 may comprise a dual ply (or multi-ply) construction in which a ply in contact with the base label 100 is a material selected for low sliding friction characteristics. The low sliding friction characteristics may enhance the ease of rotating and sliding the top label 300 about the base label 100. In various embodiments, the top label 300 ply in contact with the base label 100 may be coated with a substance to impart the low sliding friction characteristics.

Figure 16:
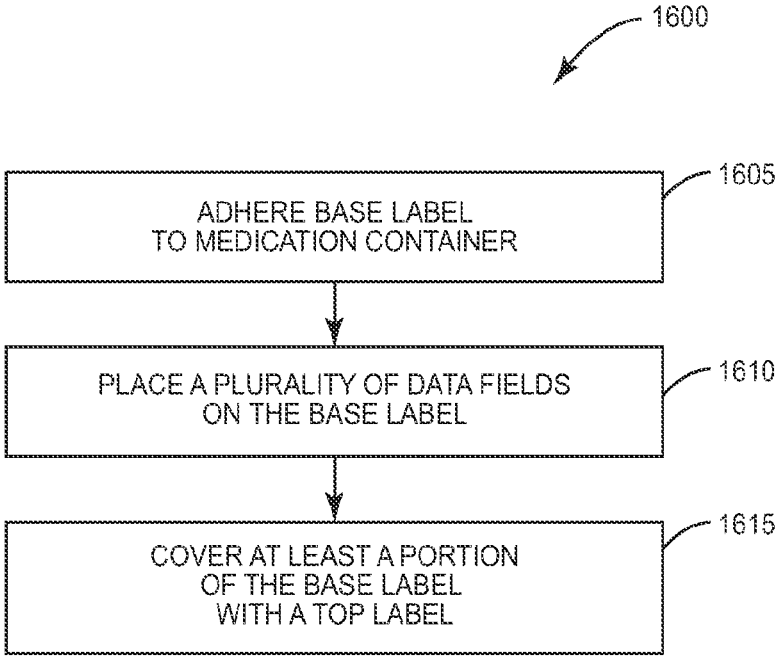
FIG. 16 is an exemplary flow diagram of a method for tracking progress in connection with taking medication from a medication container according to various embodiments.

FIG. 16 illustrates a general flow chart of various embodiments of a method 1600 for tracking progress in connection with taking medication from a medication container. A base label 100 may be applied to a medication container 1401 (step 1605). A plurality of data fields may be placed on the base label 100 (step 1610). Each data field may correspond to a type of patient information. At step 1615, at least a portion of the base label 100 may be covered with a top label 300. In various embodiments, a progress tracking indicia may be printed on the base label 100.

In various embodiments, the patient identification information section 1205 and the patient progress tracking information section 1210 may be imprinted, embossed, or molded directly on the medication container 1401 in place of all or a portion of the base label 100.

Spatially relative terms such as "under", "below", "lower", "over", "upper", and the like, are used for ease of description to explain the positioning of one element relative to a second element. These terms are intended to encompass different orientations of the device in addition to different orientations than those depicted in the figures. Further, terms such as "first", "second", and the like, are also used to describe various elements, regions, sections, etc. and are also not intended to be limiting. Like terms refer to like elements throughout the description.

As used herein, the terms "having", "containing", "including", "comprising", and the like are open ended terms that indicate the presence of stated elements or features, but do not preclude additional elements or features. The articles "a", "an" and "the" are intended to include the plural as well as the singular, unless the context clearly indicates otherwise.

The present invention may be carried out in other specific ways than those herein set forth without departing from the scope and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A progress tracking aid for a medication container, the progress tracking aid comprising:

a base label adhered to the medication container;

a plurality of data fields on the base label, each data field corresponding to a type of patient information; and a top label covering at least a portion of the base label, the top label having a dual ply construction with a vertical height less than a corresponding vertical height of the base label, the top label configured for rotating around a circumference of the base label and the top label configured for sliding in a vertical dimension over the base label, with the sliding without the rotating resulting in exposure of a previously covered segment of the portion of the base label, the previously covered segment configured to receive an indicia of progress of a user of the medication container.

2. The progress tracking aid for the medication container of claim 1, wherein the data field is markable with a pen or pencil.

3. The progress tracking aid for the medication container of claim 1, the top label further comprising:

a progress tracking indicia printed on the top label.

4. The progress tracking aid for the medication container of claim 1, wherein the top label slides over the base label.

5. The progress tracking aid for the medication container of claim 4, wherein the top label slides over at least one of the plurality of data fields.

6. The progress tracking aid for the medication container of claim 1, wherein the top label rotates over the base label.

7. The progress tracking aid for the medication container of claim 1, wherein the top label further comprises:

any of medication-related information, patient-related information or medical provider-related information.

8. The progress tracking aid for the medication container of claim 1, wherein the medication container is a bottle.

9. The progress tracking aid for the medication container of claim 1, wherein the type of patient information is patient blood pressure.

10. The progress tracking aid for the medication container of claim 1, wherein the type of patient information is patient name.

11. The progress tracking aid for the medication container of claim 1, wherein the type of patient information is patient birthdate.

12. The progress tracking aid for the medication container of claim 1, wherein the type of patient information is patient weight.

13. The progress tracking aid for the medication container of claim 12, wherein the patient weight is a starting weight.

14. The progress tracking aid for the medication container of claim 12, wherein the patient weight is a goal weight for the patient.

15. The progress tracking aid for the medication container of claim 12, wherein the patient weight is a weight corresponding to a particular date of medication administration.

16. The progress tracking aid for the medication container of claim 1, wherein the type of patient information is patient contact information.

17. The progress tracking aid for the medication container of claim 1, wherein the type of patient information is patient medical provider.

18. The progress tracking aid for the medication container of claim 1, wherein the type of patient information is an indicator of patient compliance.

19. The progress tracking aid for the medication container of claim 1, wherein the type of patient information is date of medication administration.

20. The progress tracking aid for the medication container of claim 1, wherein the type of patient information is blood sugar level.

21. The progress tracking aid for a medication container of claim 1, wherein the top label is of dual ply construction.

22. The progress tracking aid for the medication container of claim 1, wherein the data field is scratchable.

23. The progress tracking aid for the medication container of claim 1 further comprising:

a data field on the base label corresponding to a type of medication-related information.

24. The progress tracking aid for the medication container of claim 1, wherein the type of patient information is any patient-related information.

25. A method for tracking progress in connection with taking medication from a medication container, the method comprising:

adhering a base label to the medication container;

placing a plurality of data fields on the base label, each data field corresponding to a type of patient information; and covering at least a portion of the base label with a top label, the top label having a dual ply construction with a vertical height less than a corresponding vertical height of the base label, the top label configured for rotating around a circumference of the base label and the top label configured for sliding in a vertical dimension over the base label, with the sliding without the rotating resulting in exposure of a previously covered segment of the portion of the base label, the previously covered segment configured to receive an indicia of progress of a user of the medication container.

26. The method of claim 25 further comprising:

printing a progress tracking indicia on the top label.

* * * * *